US006019542A

United States Patent [19]

Bent et al.

[11] Patent Number: 6,019,542

[45] Date of Patent: Feb. 1, 2000

[54] DROP-OVER BASE FOR TRAFFIC DELINEATION DEVICE

[75] Inventors: Bruce C. Bent; James A. Bent, both of Huntington Beach, Calif.

[73] Assignee: Bent Manufacturing Company, Huntington Beach, Calif.

[21] Appl. No.: 09/012,684

[22] Filed: Jan. 23, 1998

[51] Int. Cl.[7] ..... E01F 13/02

[52] U.S. Cl. ..... 404/6; 404/9; 116/63 P

[58] Field of Search ..... 404/6, 9, 10; 256/1, 256/13.1; 116/63 P, 63 C

[56] References Cited

U.S. PATENT DOCUMENTS

| | | | |
|---|---|---|---|
| D. 60,293 | 1/1922 | Meden . | |
| D. 235,744 | 7/1975 | England | D10/109 |
| D. 243,073 | 1/1977 | Kulp et al. | D10/109 |
| D. 243,074 | 1/1977 | Kulp et al. | D10/109 |
| D. 243,075 | 1/1977 | Kulp et al. | D10/109 |
| D. 272,809 | 2/1984 | Bent et al. . | |
| D. 276,510 | 11/1984 | Bent et al. | D10/109 |
| D. 279,275 | 6/1985 | Cory | D10/109 |
| D. 310,642 | 9/1990 | Kulp | D10/109 |
| D. 320,172 | 9/1991 | Thurston | D10/113 |
| 2,448,413 | 8/1948 | Borghesi | 248/194 |
| 2,456,685 | 12/1948 | Delmotte | 177/329 |
| 2,483,734 | 10/1949 | Neal | 40/125 |
| 2,564,145 | 8/1951 | Beall et al. | 177/329 |
| 2,628,587 | 2/1953 | Peters et al. | 116/63 |
| 2,649,803 | 8/1953 | Andre | 46/25 |
| 2,762,327 | 9/1956 | Weig | 116/63 |
| 2,762,328 | 9/1956 | Weig | 116/63 |
| 2,808,803 | 10/1957 | Weig | 116/63 |
| 2,817,308 | 12/1957 | Scanlon | 116/63 |
| 2,843,347 | 7/1958 | King | 248/44 |
| 2,957,444 | 10/1960 | Boettler | 116/63 |
| 2,977,864 | 4/1961 | Pullar | 94/22 |
| 3,099,244 | 7/1963 | Knapp | 116/63 |
| 3,119,588 | 1/1964 | Keats | 248/158 |
| 3,231,994 | 2/1966 | Cyrus | 40/125 |
| 3,380,428 | 4/1968 | Abrams | 116/63 |
| 3,451,368 | 6/1969 | Keats | 116/63 |
| 3,471,114 | 10/1969 | Ball | 248/346 |
| 3,499,413 | 3/1970 | Heard | 116/63 |
| 3,520,235 | 7/1970 | Palazzolo | 94/1.5 |
| 3,563,445 | 2/1971 | Fairport | 229/25 |
| 3,618,556 | 11/1971 | Dittrich | 116/63 |
| 3,619,443 | 11/1971 | Feldman | 264/89 |
| 3,664,085 | 5/1972 | Rousseau et al. | 53/112 |
| 3,664,618 | 5/1972 | Krueger | 248/44 |

(List continued on next page.)

FOREIGN PATENT DOCUMENTS

| | | | |
|---|---|---|---|
| 216329 | 6/1956 | Australia | 116/63 |
| 2 580 050 | 10/1986 | France . | |
| 2 233 994 | 2/1974 | Germany . | |
| 665785 | 1/1952 | United Kingdom | 116/63 |
| 1058881 | 2/1967 | United Kingdom . | |
| 1 301 084 | 12/1972 | United Kingdom . | |
| 2 077 332 | 5/1981 | United Kingdom . | |
| 2 090 313 | 12/1981 | United Kingdom . | |
| 2 081 348 | 2/1982 | United Kingdom . | |
| 2 101 180 | 1/1983 | United Kingdom . | |
| 2 122 239 | 5/1983 | United Kingdom . | |
| 2 156 409 | 3/1984 | United Kingdom . | |
| 2 182 701 | 10/1986 | United Kingdom . | |

OTHER PUBLICATIONS

"11215" Prior to 1991 Safetycade.
"11207" Oct. 17, 1991 Flasher Flare.
"11352" Oct. 17, 1991 Traffic Safety Service
"B0384" Prior to 1992 Best Barricade.

*Primary Examiner*—James A. Lisehora
*Attorney, Agent, or Firm*—J. Harrison Colter

[57] ABSTRACT

A D-shaped base fits tightly over a barrel to add ballast to the barrel. The base is perimeter weighted to increase resistance to tipping of the barrel. The interior circumference is designed to fit tightly on the barrel. The outer circumference includes a flat portion to resist rolling of the barrel if tipped over. As a result, if the barrel is tipped over, the base stays tightly fitted to the barrel, but if an automobile collides with the barrel, the base releases to reduce the possibility of damage to the automobile or barrel or base.

11 Claims, 5 Drawing Sheets

U.S. PATENT DOCUMENTS

| | | | |
|---|---|---|---|
| 3,675,811 | 7/1972 | Artz | 220/20 |
| 3,701,456 | 10/1972 | Alroy | 220/97 |
| 3,738,309 | 6/1973 | Nichol | 116/63 |
| 3,751,852 | 8/1973 | Schrepper | 47/34 |
| 3,794,090 | 2/1974 | Commisso | 150/0.05 |
| 3,809,007 | 5/1974 | Brown | 116/63 |
| 3,822,668 | 7/1974 | Schradieck | 116/63 |
| 3,825,114 | 7/1974 | Johnson et al. | 206/507 |
| 3,846,935 | 11/1974 | Wagner | 47/26 |
| 3,913,518 | 10/1975 | Kaplan | 116/63 |
| 3,916,816 | 11/1975 | Fitch | 116/63 |
| 3,949,701 | 4/1976 | Teixeira | 116/63 |
| 3,950,208 | 4/1976 | Pavuk et al. | 264/156 |
| 3,952,690 | 4/1976 | Rizzo et al. | 116/63 |
| 4,006,702 | 2/1977 | St. Cyr | 116/63 |
| 4,007,919 | 2/1977 | Totten | 256/59 |
| 4,019,271 | 4/1977 | Latimer | 40/125 |
| 4,026,086 | 5/1977 | Langley | 52/582 |
| 4,040,759 | 8/1977 | Skalle | 404/6 |
| 4,053,100 | 10/1977 | Baptist | 229/43 |
| 4,054,207 | 10/1977 | Lazure et al. | 206/486 |
| 4,071,224 | 1/1978 | Gilbert | 256/64 |
| 4,083,033 | 4/1978 | Kulp et al. | 340/114 |
| 4,102,453 | 7/1978 | Carroll et al. | 206/507 |
| 4,120,398 | 10/1978 | Braddon et al. | 206/413 |
| 4,134,533 | 1/1979 | Heavner | 229/34 |
| 4,145,044 | 3/1979 | Wilson et al. | 273/1.5 R |
| 4,175,661 | 11/1979 | Barnes | 206/519 |
| 4,184,604 | 1/1980 | Amberg et al. | 220/254 |
| 4,187,647 | 2/1980 | Hall | 52/20 |
| 4,188,151 | 2/1980 | Hall | 404/26 |
| 4,197,808 | 4/1980 | Kinninger | 116/63 |
| 4,201,975 | 5/1980 | Marcus | 340/84 |
| 4,239,137 | 12/1980 | Arcoutte | 224/319 |
| 4,256,050 | 3/1981 | Barnard | 116/63 |
| 4,289,419 | 9/1981 | Young et al. | 404/6 |
| 4,291,830 | 9/1981 | Sorensen | 229/45 R |
| 4,298,186 | 11/1981 | Glass | 256/64 |
| 4,303,349 | 12/1981 | Upton | 404/6 |
| 4,312,600 | 1/1982 | Schaaf et al. | 404/6 |
| 4,317,617 | 3/1982 | Charlton | 350/97 |
| 4,329,800 | 5/1982 | Shuman . | |
| 4,334,616 | 6/1982 | Wilson | 206/505 |
| 4,348,133 | 9/1982 | Trent et al. | 404/6 |
| 4,349,147 | 9/1982 | Jensen | 229/34 |
| 4,418,863 | 12/1983 | Kimbrell, Sr. | 229/49 |
| 4,441,600 | 4/1984 | Caray | 192/89 B |
| 4,441,615 | 4/1984 | Goodrich | 206/511 |
| 4,466,376 | 8/1984 | Wells | 116/63 |
| 4,475,101 | 10/1984 | Kulp et al. | 340/114 |
| 4,516,109 | 5/1985 | Thurston | 340/114 |
| 4,520,928 | 6/1985 | Wilson | 206/505 |
| 4,570,798 | 2/1986 | Wilson | 206/505 |
| 4,596,489 | 6/1986 | Mariol et al. | 404/10 |
| 4,611,919 | 9/1986 | Schmanski | 404/9 |
| 4,624,210 | 11/1986 | Glass | 116/63 |
| 4,674,431 | 6/1987 | Cory | 116/63 |
| 4,688,766 | 8/1987 | Zucker | 256/13.1 |
| 4,710,053 | 12/1987 | Kulp et al. | 404/9 |
| 4,772,869 | 9/1988 | Grammas et al. | 340/114 |
| 4,782,783 | 11/1988 | Kulp et al. | 116/63 |
| 4,792,258 | 12/1988 | Goff | 404/6 |
| 4,852,511 | 8/1989 | Look et al. | 116/63 |
| 4,859,983 | 8/1989 | Kulp et al. | 340/908.1 |
| 4,925,334 | 5/1990 | Beard | 404/9 |
| 4,973,190 | 11/1990 | Erwin et al. | 404/10 |
| 5,003,912 | 4/1991 | Thurston | 116/63 |
| 5,009,541 | 4/1991 | Thurston | 404/6 |
| 5,026,204 | 6/1991 | Kulp et al. | 404/10 |
| 5,036,791 | 8/1991 | Thurston | 116/63 |
| 5,046,885 | 9/1991 | Thurston | 404/10 |
| 5,103,616 | 4/1992 | Nordberg | 52/585 |
| 5,165,818 | 11/1992 | Newhart | 404/10 |
| 5,168,827 | 12/1992 | Junker | 116/63 |
| 5,199,813 | 4/1993 | Nagler | 404/9 |
| 5,199,814 | 4/1993 | Clark et al. | 404/10 |
| 5,201,599 | 4/1993 | Kulp et al. | 404/6 |
| 5,220,740 | 6/1993 | Brault | 40/606 |
| 5,234,280 | 8/1993 | Cowan | 404/6 |
| 5,306,106 | 4/1994 | Mileti | 404/6 |
| 5,354,031 | 10/1994 | Bilotti | 248/519 |
| 5,387,049 | 2/1995 | Duckett | 404/6 |
| 5,446,984 | 9/1995 | Kulp et la. | 40/610 |
| 5,451,118 | 9/1995 | Wilkins et al. | 404/6 |
| 5,458,434 | 10/1995 | Bent et al. | 404/6 |
| 5,484,225 | 1/1996 | Warner | 404/9 |
| 5,540,007 | 7/1996 | Kulp et al. | 40/610 |
| 5,560,732 | 10/1996 | Kulp et al. | 404/10 |
| 5,577,824 | 11/1996 | Wright | 340/908.1 |
| 5,722,788 | 3/1998 | Bent et al. | 404/6 |
| 5,755,528 | 5/1998 | Kulp et al. | 404/6 |
| 5,772,357 | 6/1998 | Evans | 404/7 |
| 5,860,237 | 1/1999 | Johnson | 40/603 |
| 5,868,520 | 2/1999 | Kulp et al. | 404/6 |

DROP-OVER BASE FOR TRAFFIC DELINEATION DEVICE

BACKGROUND OF THE INVENTION

This invention relates generally to traffic delineators, and more particularly to a base for a plastic traffic delineation barrel.

The development of plastic traffic delineation devices, such as plastic barrels for directing and channeling traffic flows, has significantly increased automotive transportation safety. An automobile that strikes a wood or metal barrel may be seriously damaged, the collision may cause injury to the occupants of the automobile, and the barrel could be destroyed. If the automobile strikes a plastic barrel, the lightweight barrel causes little damage to the vehicle, is less likely to cause injury to the vehicle occupants, and the barrel is not usually significantly damaged and therefore may be used again.

Because of the light weight of plastic barrels, even a light to moderate wind can blow a barrel over or out of position. Sand bags have been placed on the tops of the barrels, but heavy sand bags at an elevated height create potential safety problems. Earlier barrels were mounted to a light plastic base and sand bags were put inside the barrel. This gave the necessary ballast, and kept the sand bags out of the way, but still resulted in the necessity of bringing the sand bags to the site.

Other prior barrels have been attached to heavy bases. Typically, the barrel had an overhang that engaged with an interior lip on the bottom of the barrel to hold the barrel to the base (see FIG. 7). One such base was invented by, and is presently being sold by, the assignee of this invention. Although this type of heavy base has important uses, there are times when a lighter base is useful. Also, barrels may not be stacked when attached to such a base, and thus the base must be removed for efficient storage.

Borrowing an idea from traffic delineation cones, a drop-over base was developed that interacted with the outer wall of the barrel to grip the barrel and provide the needed ballast. One type of prior drop-over base is depicted in U.S. Pat. No. 5,234,280. The drop-over base, having a large opening in the middle, was lighter than the full bottom bases.

Previous drop over bases have several drawbacks. For instance, previous bases have been designed to fit loosely down unto the barrel. As a result, even a glancing blow to the barrel might release the barrel from the base. Furthermore, the loose fit configuration results in a greater portion of the weight of the base being on in inner diameter rather than the perimeter of the base. This reduces the relative weight available for resisting the toppling of the barrel due to wind or minor blows.

These drawbacks have resulted in a need for a better and more adaptable base that is compatible with current barrels but does not have the disadvantages of existing bases. However, no barrel base has yet been developed that accomplishes these goals.

SUMMARY OF THE INVENTION

According to the present invention, a base is provided for existing barrels that overcomes these and other drawbacks of the prior bases. The base has a central opening, and thereby forms a generally toroidal or doughnut shape with an outer diameter and an inner diameter. A base made according to the present invention is inexpensive to manufacture, interchangeable with existing bases and can be made in a variety of shapes and from a variety of materials.

The base according to the present invention has an upper portion that engages with the outer wall around the entire circumference of the barrel. The base is designed to form a tight fit with the barrel. As a result, the base according to the present invention is better able to hold the barrel on the base even when the barrel is tipped over.

Many existing barrels have a cross-sectional "D" shape. That is, though most of the circumference of the barrel is arcuate or circular, one portion is relatively flat. As a result, the barrel is significantly less prone to roll when tipped over.

The base according to the present invention includes a relatively flat side on its inner circumference so that it matches and can be tightly fit onto the existing D-shaped barrels. Furthermore, the base preferably includes at least one flat side on its exterior surface. This flat side may be parallel to the interior flat side, which facilitates molding of a consistently wide base thickness around the entire base for evenly dispersed weight. Alternatively, the flat exterior side may be separated by ninety or even 180 degrees from the interior flat side, or a series of exterior flat sides may be used formed in the outer circumference of the base. The exterior flat side also assists in reducing the tendency of the barrel to roll when tipped over.

The base according to the present invention may be made of molded vinyl, molded rubber, or another heavy elastic material such as vinyl. The base may be made, in part or entirely, of recycled materials.

The base is designed to have a significant proportion of its weight on the perimeter of the base. The center of gravity of the base does not shift and therefore the base resists tipping of the barrel. The base has a low profile in traffic, and the void in the center of the base renders the base collapsible. This reduces the risk of significant damage should an automobile roll over the base when the base in not planted firmly on the ground.

BRIEF DESCRIPTION OF THE DRAWINGS

Other features and advantages of the present invention will be apparent from the following Detailed Description taken in conjunction with the accompanying Drawings, in which.

DETAILED DESCRIPTION

Figure 2:
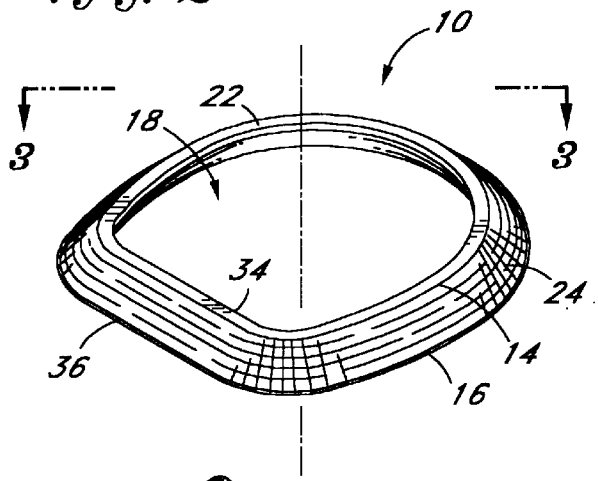
FIG. 2 is a perspective view of the base of the present invention with the base shown detached from, and above, the barrel.

As shown in the drawings, the present invention is embodied in a base 10 that is designed to be removably mounted on a barrel 12. The base 10 is a unitary piece and is designed to fit tightly onto the barrel. The base 10 includes a lower portion 14 and an upper portion 16, and forms a toroid with a large inner opening 18.

As depicted in FIGS. 3, 4, 5 and 6, the base 10 has a small, generally flat top 22, an outer tapered side 24, and a flat bottom 26. A series of recessed cusps 30 are formed around the circumference of the bottom of the base. The tapered side starts at ground level and extends upward and inward toward the opening 18 in a ramp fashion. The tapered side accommodates vehicle tire roll over, so that an automobile may roll over the base without catching or dragging and without harming the automobile or the base. At such times, compression of the cusps causes a mild suction between the base and the road surface, thereby reducing the tendency of the base to move because of the movement of the automobile.

The tapered side 24 and the cusps 30 also permit a reduction in the weight of the base 10, resulting in greater perimeter weighting of the base. That is, by using a tapered side and cusps in the bottom 26 of the base, the maximum proportion of the prescribed weight of the base remains at or near the perimeter of the base, that is, the furthest distance from the barrel. This provides a lower weight base that has the same or better ability to keep the barrel in place and upright, and allows a greater chance of self-uprighting recovery of the barrel. The result is less cost per unit and less weight burden for workers.

Figure 3:
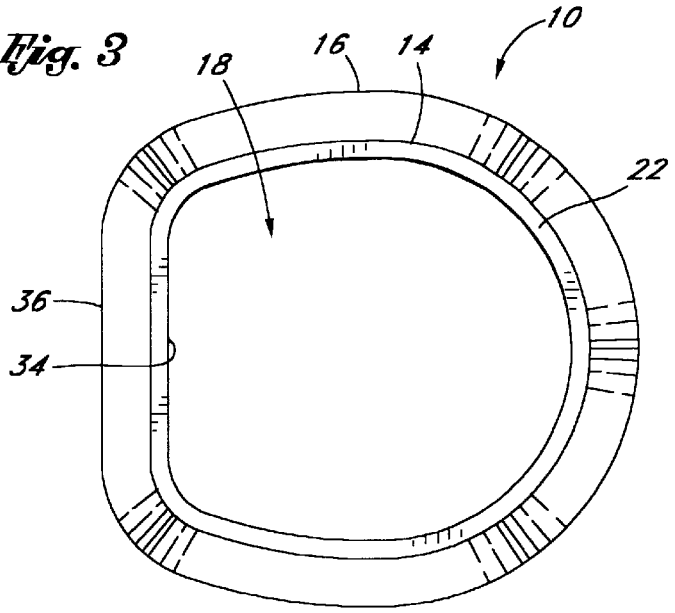
FIG. 3 is a top view of the base of the present invention taken along the line 3—3 of FIG. 2.
Figure 4:
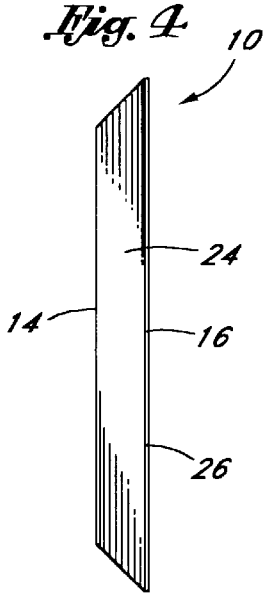
FIG. 4 is a first side view of the base of the present invention.
Figure 5:
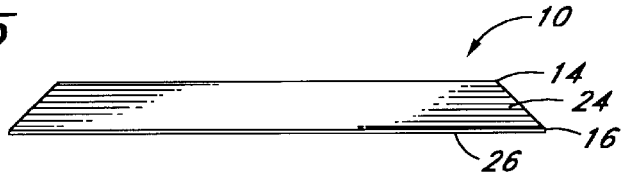
FIG. 5 is a second side view of the base of the present invention.

As depicted best by FIG. 3, the inner circumference of the base 10 is mostly of a curved or arcuate form, but includes at least one flat interior surface 34, and thus forms something of a "D" cross-sectional shape. This shape is important for mating with existing barrels 12, many of which have a similar "D" cross-sectional shape to reduce the tendency of a barrel to roll when tipped over. The flat interior surface not only form-fits with the barrel but also prohibits the spinning, rotating or loosening of the barrel from the base. This helps to prevent the disorienting of the barrel from its original directional placement or orientation.

Figure 6:
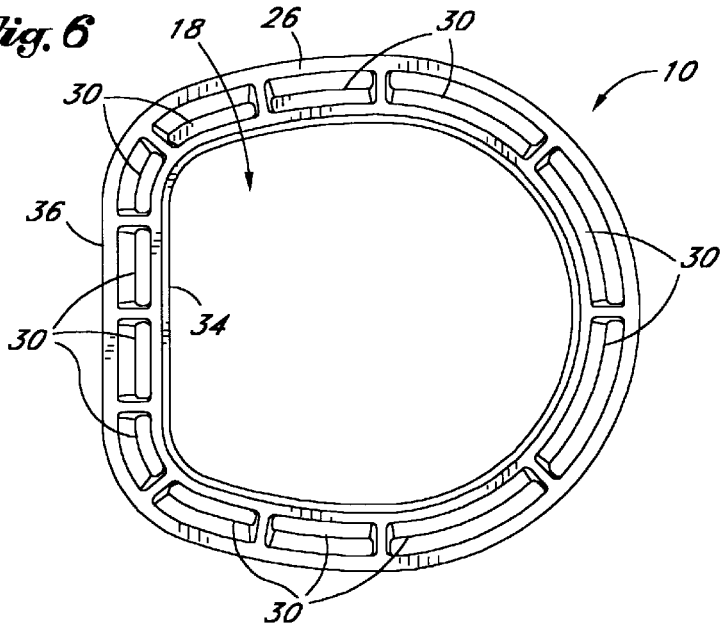
FIG. 6 is a bottom view of the base of the present invention.
Figure 7:
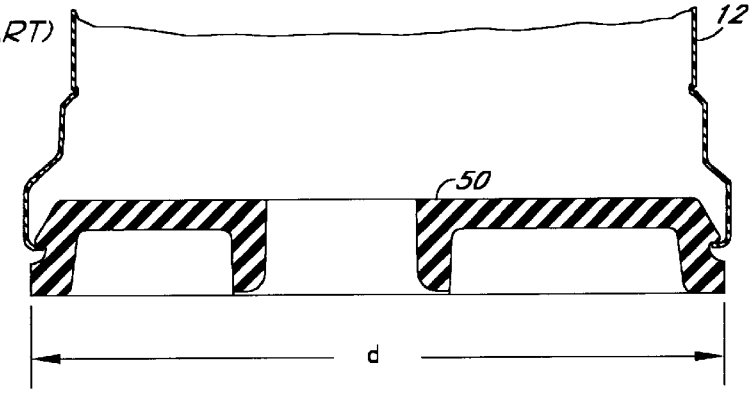
Fig. 7 (PRIOR ART)
FIG. 7 is a cross-sectional view of a prior barrel and base.

The exterior circumference of the base 10 also has a mostly curved or arcuate shape. However, it is also preferably designed with at least one flat exterior side 36, again resulting in a "D" shape for the exterior circumference of the base. The exterior flat side 36 may be parallel to the interior flat surface 34, as depicted in FIGS. 3 and 6, or it may be offset any number of degrees from the interior flat surface. If the pre-existing barrel has no flat surface, the base is designed without a flat interior surface 34. However, a flat exterior surface 36 may still be included on the base 10, and thus the base provides anti-rolling characteristics, or no flat exterior surface may be included if anti-rolling characteristics are not necessary or desirable.

Figure 1:
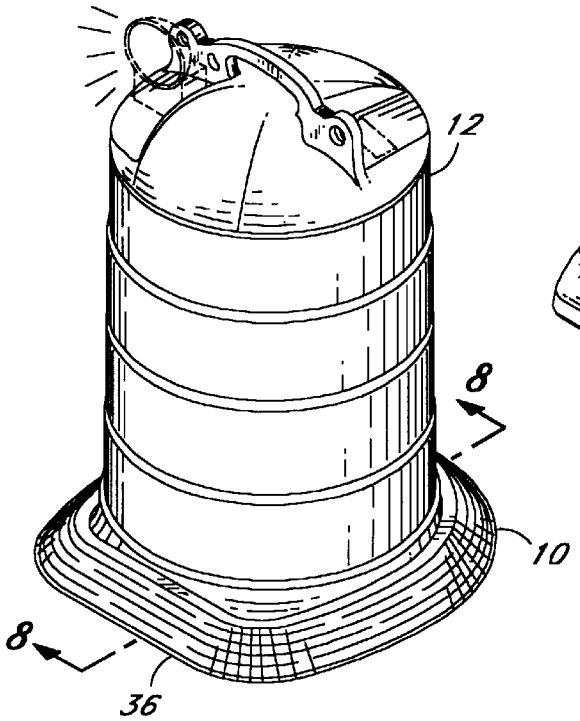
FIG. 1 is a perspective view of the base of the present invention attached to a barrel.
Figure 8:
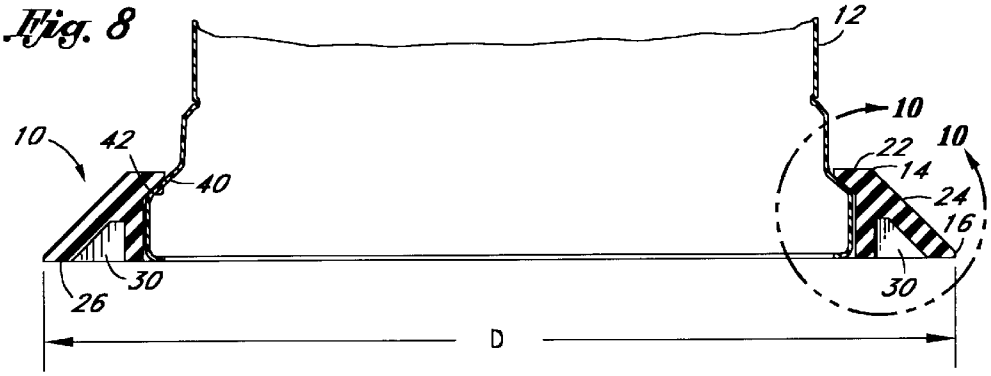
FIG. 8 is a cross-sectional view of the barrel and the base of FIG. 1 taken along the line 8—8 shown in FIG. 1.
Figure 10:
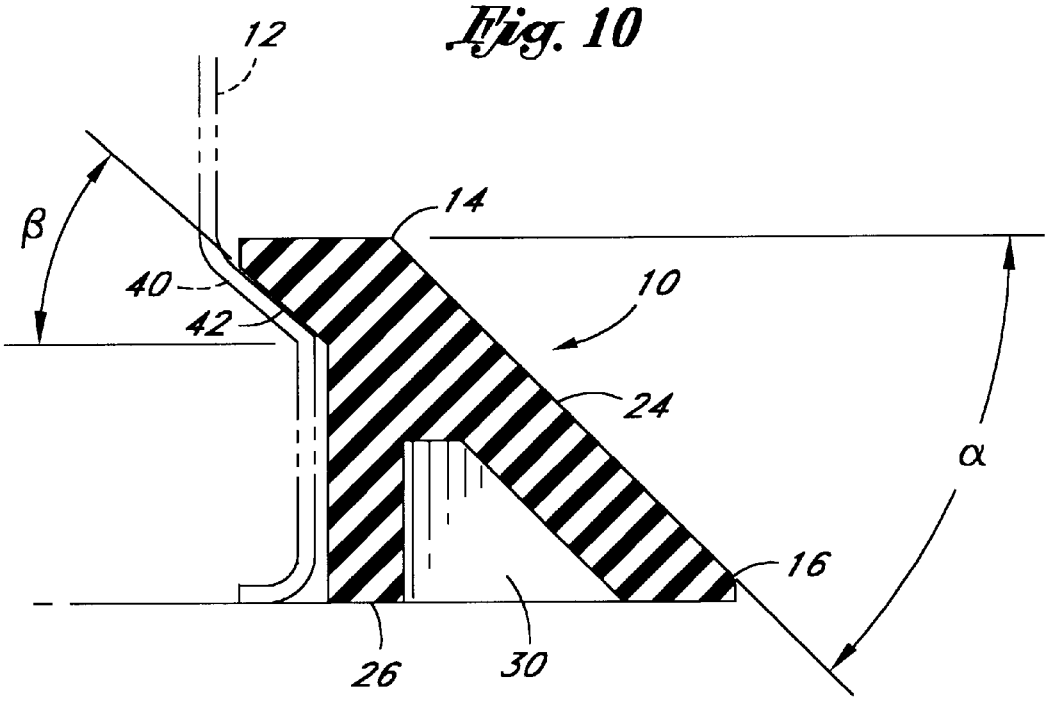
FIG. 10 is a partial cross-sectional view of the barrel and base taken along the line 10—10 of FIG. 8 showing the interconnection of the barrel and the base according to a first embodiment of the invention.
Figure 11:
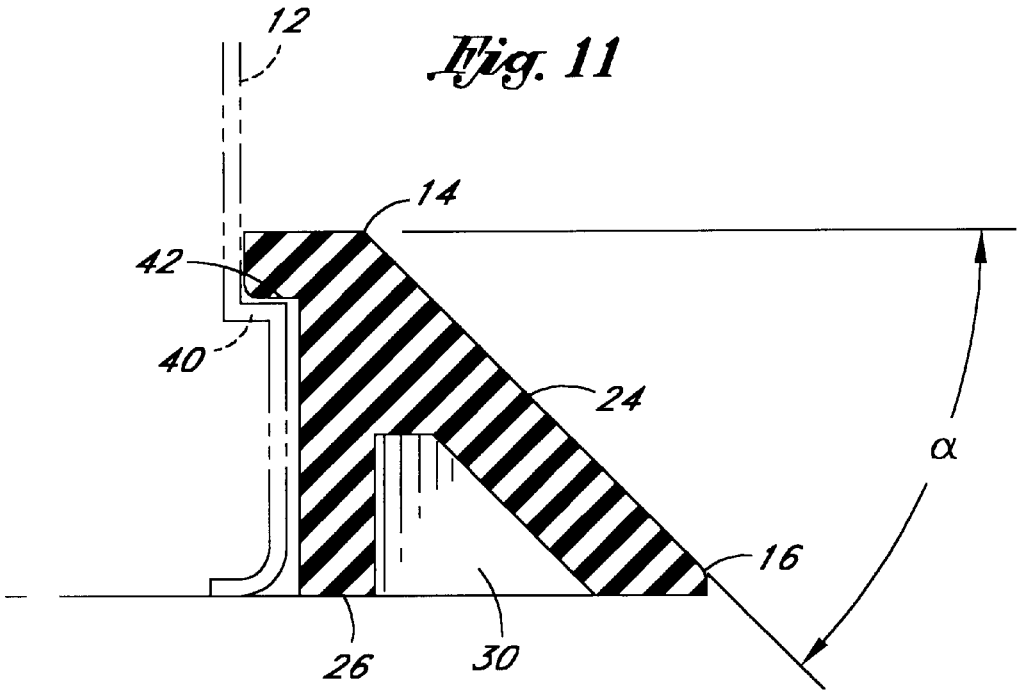
FIG. 11 is a partial cross-sectional view of the barrel and base of FIG. 1 showing the interconnection of the barrel and the base according to a second embodiment of the invention.

As perhaps best depicted in FIGS. 1 and 2, the base 10 is mounted on a barrel 12 by placing the base over the barrel so that the base drops down and engages with the lower portion 14 of the barrel. As perhaps best shown in FIGS. 8, 10 and 11, the bottom portion of the barrel includes an expanded diameter that forms a ledge 40 extending around the circumference of the barrel 12. The ledge engages with a tapered lip 42 of the base 10 to hold the base unto the barrel. Different barrels have different designs of ledges 40, and so different tapered lip 42 designs may also be necessary, as can be seen by comparing the ledges and tapered lips depicted in FIGS. 10 and 11.

The tapered lip 42 tightly grips the ledge 40 the complete circumference of the base 10 and barrel 12. Preferably, the form, shape, dimensions and angles of the molded base match the form, shape, dimensions and angles of the bottom of the barrel. This allows complete circumferential contact holding the base to the bottom of the barrel. The base thereby forms a very tight fit with the barrel, so that even if the barrel tips over, the tapered lip 42 continues to grip the ledge 40 and the base stays tightly engaged with the bottom of the barrel and does not slip up the side of the barrel. The result is a firm connection between the barrel and the base. This firm connection results in increased ability for the upright barrel and base to recover after a minor glancing blow or impact by a vehicle as compared to barrels that tend to pull through or snap off of loose fitting bases.

Figure 9:
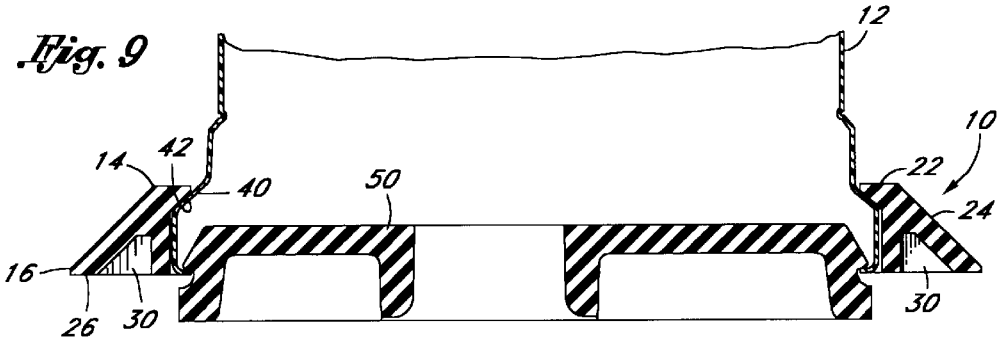
FIG. 9 is a cross-sectional view of the barrel and base shown in FIG. 1 showing the barrel attached to the prior base as well as the base of the present invention.

The tight fit of the base 10 to the barrel 12 holds the barrel on the base even after a glancing impact, and the weight of the base keeps the barrel upright even during moderate winds. However, upon a significant impact, the barrel will partially collapse and then detach from the base, allowing the vehicle to drive over base, thereby reducing the risk of damage or injury. Furthermore, as shown in FIG. 9, if additional weight is desired, both a prior art base 50 and a base 10 according to the present invention can be mounted to the existing barrels. In such a case, both bases 10 and 50 will detach from the barrel 12 upon impact, yet significant flexibility is provided in the amount of ballast that can be used.

The base 10 is low to the ground. As a result, if the barrel 12 is detached from the base, the base remains in position but does not create a traffic hazard nor is it likely to be rapidly destroyed by further automobile impacts. The base is flexible so that If caught up under an automobile, the base contorts, twists and collapses into the inner opening 18, and thereby reduces the risk of damage to the under side of the automobile.

The base 10 is preferably molded from inorganic materials (such as clay or calcium carbonate) held together with an organic binder. However, the base may be molded from new plastics, including vinyl, urethane or polyethylene, or from recycled plastics, even combinations of recycled plastics. The plastic may be pure, but preferably the plastic is highly filled with clay, calcium carbonate, or other inorganic fillers as is known in the art. Chopped fiberglass may be added to the plastic to provide significant additional strength to the base. Scrap polyethylene or scrap vinyl may also be used. The base could even be formed from paper, recycled newsprint or other recyclable materials, as weather and durability requirements permit. The base preferably has a specific gravity of about 1.5, so that the base can be made heavy without undue size or cost, but not all appropriate materials allow such a high specific gravity. Furthermore, the base can be made hollow, with an opening to insert for sand or water ballast, as is known in the art.

Figure 12:
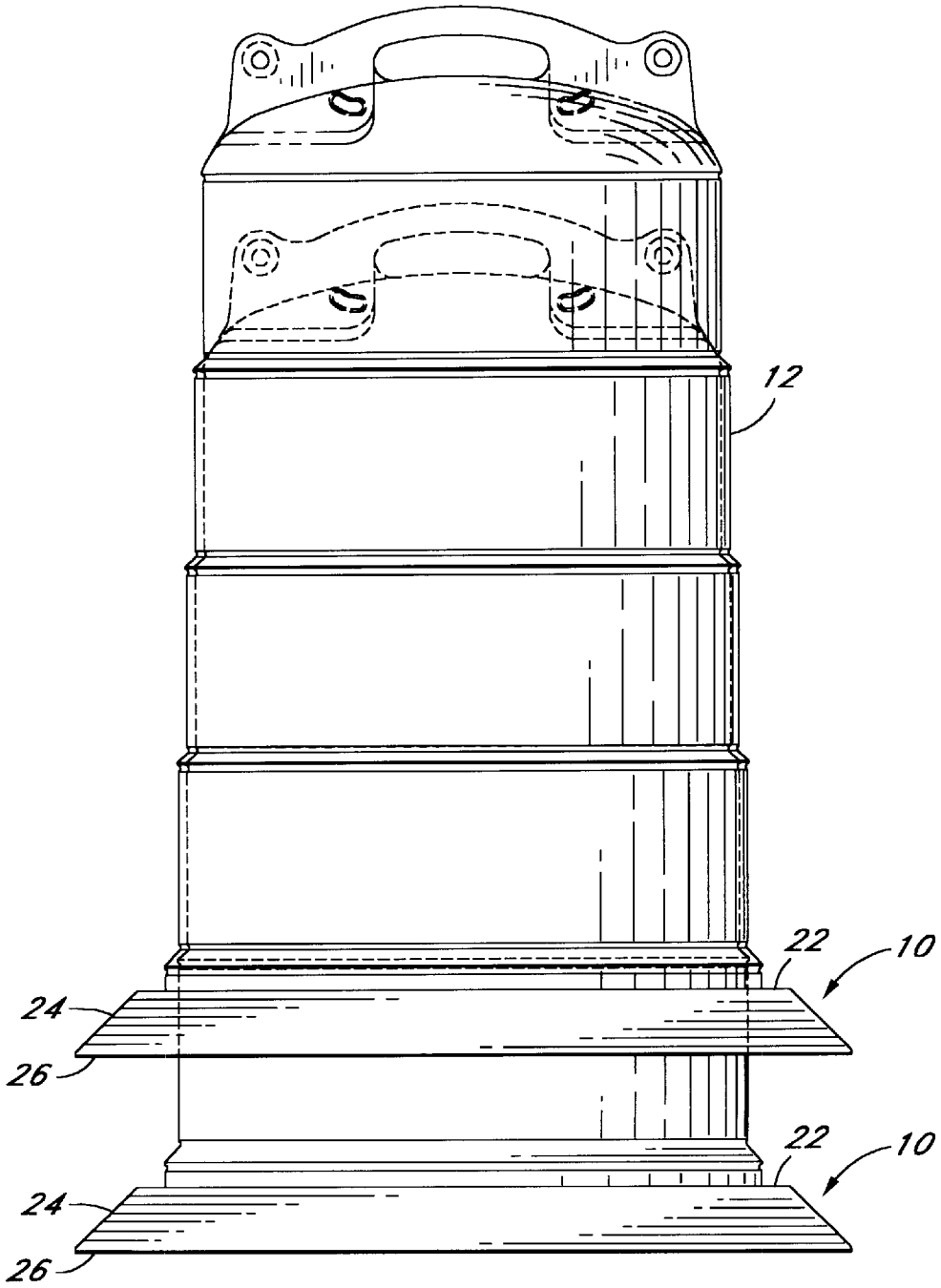
FIG. 12 is a side view of two stacked barrels each having a base according to the present invention affixed thereto.

As depicted in FIG. 12 and unlike many prior bases, barrels 12 can be stacked without removing the base 10. This is especially useful when barrels are to be moved a short distance and workers do not wish to take the time to remove the bases, but still want to be able to stack bases to conserve space.

Although one embodiment of the invention has been illustrated and described, various modifications and changes may be made by those skilled in the art without departing from the spirit and scope of the invention.

We claim:

1. A traffic delineation apparatus comprising:

a deformable stackable hollow plastic barrel having a top, a bottom, a predetermined height and circumference, and at least one flat outer surface formed in at least the bottom of the barrel, the bottom of the barrel forming an opening and having a radially inwardly extending lip about the circumference of the barrel, the bottom further forming an expanded diameter ledge; and a toroidal, detachable, low profile, self-ballasting, unitary molded base having a vertical opening therethrough, the base having dimensions and being adapted to receive the barrel through the opening and make a tight fit thereto, the base including:

an upper portion that forms a tapered outer radial surface and an inner radial surface having a predetermined molded shape with a radially inwardly directed tapered lip to engage with the ledge and at least one flat interior surface to fit snugly around substantially the entire circumference of the bottom of the barrel and thereby create a tight fit between the barrel and base when the base is dropped down unto the barrel; and a ground engaging radially outwardly extending lower portion having a relatively larger cross-sectional area compared to the upper portion and to the cross-sectional area of the barrel, the lower portion having an inner radial ground engaging ring and an outer radial ground engaging ring and forming a series of recessed cusps circumferentially distributed about the base between the inner ring and the outer ring to reduce the weight of the base and to provide perimeter weighting to the base;

whereby the relatively larger cross-sectional area of the lower portion extends significantly circumferentially outwardly beyond the upper portion and the barrel around the entire circumference of the barrel when the base is placed unto the barrel.

2. The traffic delineation apparatus of claim 1 wherein the base is molded from pure plastic.

3. The traffic delineation apparatus of claim 1 wherein the base is molded from recycled plastic.

4. The traffic delineation apparatus of claim 1 wherein the base is molded from plastic filled with inorganic materials.

5. The traffic delineation apparatus of claim 1 wherein the base is molded from plastic filled with chopped fiberglass.

6. A generally toroidal, detachable, low profile, self-ballasting, unitary molded base having a vertical opening adapted to receive a barrel having at least one flat outer surface therethrough, the base having dimensions and being adapted to receive the barrel through the opening and make a tight fit thereto, the base comprising:

a tapered outer radial surface;

an inner radial surface having a predetermined molded shape with a radially inwardly directed tapered lip to engage with the barrel and at least one flat interior surface to fit snugly around substantially the entire circumference of the barrel and thereby create a tight fit between the barrel and base when the base is dropped down unto the barrel; and a radially outwardly extending ground engaging portion having a relatively larger cross-sectional area compared to the cross-sectional area of the barrel, the ground engaging portion having an inner radial ground engaging ring and an outer radial ground engaging ring and forming a series of recessed cusps circumferentially distributed about the base between the inner ring and the outer ring.

7. The base of claim 6 further comprising a means for creating suction between the base and a road surface when downward pressure is applied to the base.

8. The base of claim 6 wherein the base is molded from pure plastic.

9. The base of claim 6 wherein the base is molded from recycled plastic.

10. The base of claim 6 wherein the base is molded from plastic filled with inorganic materials.

11. The base of claim 6 wherein the base is molded from plastic filled with chopped fiberglass.

* * * * *